US007005855B2

(12) United States Patent
Zhu et al.

(10) Patent No.: US 7,005,855 B2
(45) Date of Patent: Feb. 28, 2006

(54) DEVICE TO PROVIDE A REGULATED POWER SUPPLY FOR IN-CYLINDER IONIZATION DETECTION BY USING THE IGNITION COIL FLY BACK ENERGY AND TWO-STAGE REGULATION

(75) Inventors: Guoming G. Zhu, Novi, MI (US); Kevin D. Moran, Trenton, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 0 days.

(21) Appl. No.: 10/738,550

(22) Filed: Dec. 17, 2003

(65) Prior Publication Data

US 2005/0134281 A1 Jun. 23, 2005

(51) Int. Cl.
*F02P 17/00* (2006.01)

(52) U.S. Cl. ..... 324/380; 324/382

(58) Field of Classification Search ..... 73/35.08; 123/630; 315/290; 324/380, 382
See application file for complete search history.

(56) References Cited

U.S. PATENT DOCUMENTS

| | | | | |
|---|---|---|---|---|
| 4,069,665 A | | 1/1978 | Bolasny | 60/275 |
| 4,696,280 A | | 9/1987 | Niggemeyer | 123/598 |
| 4,900,990 A | * | 2/1990 | Sikora | 315/241 P |
| 5,060,623 A | | 10/1991 | McCoy | 123/605 |
| 5,247,919 A | | 9/1993 | Akaki et al. | 123/606 |
| 5,531,206 A | | 7/1996 | Kitson et al. | 123/596 |
| 5,548,220 A | | 8/1996 | Kawamoto et al. | 324/399 |
| 5,571,245 A | | 11/1996 | Ooyabu et al. | 123/630 |
| 5,592,118 A | | 1/1997 | Wilmot et al. | 327/440 |
| 5,602,332 A | | 2/1997 | Pyko | 73/117.3 |
| 5,636,620 A | | 6/1997 | Kiess et al. | 123/625 |
| 5,638,799 A | | 6/1997 | Kiess et al. | 123/637 |
| 5,656,966 A | | 8/1997 | Wilmot et al. | 327/440 |
| 5,675,072 A | | 10/1997 | Yasuda et al. | 73/35.08 |
| 5,755,206 A | | 5/1998 | Takahashi et al. | 123/425 |
| 5,781,012 A | | 7/1998 | Yasuda | 324/399 |

(Continued)

FOREIGN PATENT DOCUMENTS

EP 0260177 A1 3/1988

(Continued)

OTHER PUBLICATIONS

U.K. Patent Office, Combined Search and Examination Report Under Sections 17 and 18(3); dated Mar. 8, 2005 (2 pages).

*Primary Examiner*—Walter Benson
(74) *Attorney, Agent, or Firm*—Dickinson Wright PLLC

(57) ABSTRACT

The present invention is directed to a dual charge rate power supply circuit and method for ionization detection. The circuit includes a first diode, first and second capacitors, and first and second current paths. The first diode includes an anode operably connected to a first end of a primary winding. The first capacitor has a second end operably connected to ground and the second capacitor has a first end operably connected to the cathode of the first diode as well as a second end operably connected to ground. The first and second current paths are operably connected between the first and second capacitors and include a second diode, a parallel combination of a first resistor and a third diode, and a second resistor. The first diode is operably connected in parallel with the first capacitor. The second resistor has a first end operably connected to the cathode of the first diode and the parallel combination is operably connected between a second end of the second resistor and the first end of the first capacitor.

17 Claims, 8 Drawing Sheets

U.S. PATENT DOCUMENTS

| | | | | |
|---|---|---|---|---|
| 5,785,020 | A | 7/1998 | Takahashi et al. | 123/425 |
| 5,852,381 | A | 12/1998 | Wilmot et al. | 327/440 |
| 5,936,830 | A | 8/1999 | Rousseau et al. | 361/253 |
| 6,011,397 | A | 1/2000 | Yasuda | 324/388 |
| 6,040,698 | A | 3/2000 | Takahashi et al. | 324/399 |
| 6,075,366 | A | 6/2000 | Yasuda | 324/380 |
| 6,118,276 | A | 9/2000 | Nakata et al. | 324/464 |
| 6,186,129 | B1 | 2/2001 | Butler, Jr. | 123/620 |
| 6,196,054 | B1 | 3/2001 | Okamura et al. | 73/35.08 |
| 6,202,474 | B1 | 3/2001 | Takahashi et al. | 73/35.08 |
| 6,205,844 | B1 | 3/2001 | Morita et al. | 73/35.08 |
| 6,216,530 | B1 | 4/2001 | Shimizu et al. | 73/116 |
| 6,222,367 | B1 | 4/2001 | Shimizu et al. | 324/380 |
| 6,222,368 | B1 | 4/2001 | Inagaki et al. | 324/399 |
| 6,343,500 | B1 | 2/2002 | Katogi et al. | 73/35.08 |
| 6,360,587 | B1 * | 3/2002 | Noel | 73/35.08 |
| 6,378,513 | B1 | 4/2002 | Boyer et al. | 123/625 |
| 6,378,514 | B1 | 4/2002 | Kaminaga et al. | 123/633 |
| 6,450,157 | B1 | 9/2002 | Kesler et al. | 123/630 |
| 6,498,490 | B1 * | 12/2002 | Karau et al. | 324/380 |
| 6,586,896 | B1 * | 7/2003 | Menegoli | 318/254 |
| 6,600,322 | B1 * | 7/2003 | Nussbaum | 324/380 |
| 2002/0134363 | A1 | 9/2002 | Meinders | 123/620 |
| 2003/0116148 | A1 | 6/2003 | Sakakura | 123/630 |
| 2003/0168049 | A1 * | 9/2003 | Zarkhin et al. | 123/609 |

FOREIGN PATENT DOCUMENTS

| | | | |
|---|---|---|---|
| GB | 2396754 | A | 6/2004 |
| JP | 04191465 | A | 7/1992 |
| JP | 11294310 | A | 10/1999 |

* cited by examiner

PRIOR ART

PRIOR ART

DEVICE TO PROVIDE A REGULATED POWER SUPPLY FOR IN-CYLINDER IONIZATION DETECTION BY USING THE IGNITION COIL FLY BACK ENERGY AND TWO-STAGE REGULATION

BACKGROUND OF THE INVENTION

1. Technical Field

This invention is related to the field of automobile ignition diagnostic systems. More particularly, it is related to the field of supplying power to an ionization detection circuit.

2. Discussion

In a spark ignition (SI) engine, the spark plug is inside of the combustion chamber and can be used as a detection device without requiring the intrusion of a separate sensor. Many ions are produced in the plasma during combustion of an engine. For example, H3O+, C3H3+, and CHO+ are produced by the chemical reactions at the flame front and have sufficiently long excitation time to be detected. In addition, a voltage applied across the spark gap attracts free ions and creates an ionization current.

The prior art includes a variety of conventional methods for detecting and using ionization current in a combustion chamber of an internal combustion engine. However, each of the various conventional systems suffers from a great variety of deficiencies.

A typical ionization detector consists of a coil-on-plug arrangement, with a device in each coil to keep a voltage applied across the spark plug electrodes when the spark is not arcing. The current across the spark plug electrodes is isolated prior to being measured. There are two ways to supply regulated power to an in-cylinder ionization detector. A first approach is to use a charge pump powered by a DC power supply such as a battery. A second approach is to use a charge pump powered by ignition flyback energy. The DC power supply and the ignition flyback energy generate a DC bias used by the charge pump to detect ionization current.

Both approaches present disadvantages. A DC power supply is many times too large due to large high-voltage electronics. The flyback energy approach requires a few ignition events to obtain a regulated power supply. This is undesirable for cylinder identification, since cylinder identification uses a regulated power supply at the first ignition event. In addition, the high voltage capacitors used with the flyback energy approach tend to be unreliable due to the high voltage and the high operational temperature.

SUMMARY OF THE INVENTION

In view of the above, the described features of the present invention generally relate to one or more improved systems, methods and/or apparatuses for supplying power to an ionization detection circuit used to detect an ionization current in the combustion chamber of an internal combustion engine.

In one embodiment, the invention comprises a method of charging an ionization detection circuit using a plurality of charge rates.

In another embodiment, the method of charging an ionization detection circuit using a plurality of charge rates comprises charging a capacitor using a first time constant during a time period and charging the capacitor using a second time constant after the time period has elapsed.

In a further embodiment, the invention comprises a dual stage ionization detection circuit including a first diode, first and second capacitors, and first and second current paths.

The first diode includes an anode and a cathode with the anode operably connected to a first end of a primary winding. The first capacitor has a first end and a second end with the second end operably connected to ground. The second capacitor has a first end operably connected to the cathode of the first diode and a second end operably connected to ground. The first current path is operably connected between the first and the second capacitor and the second current path is operably connected between the first and the second capacitor. Each of the first and second current paths include a second diode having an anode and a cathode operably connected in parallel with the first capacitor, a parallel combination of a first resistor having a first and a second end and a third diode having an anode and a cathode, and a second resistor having a first and a second end. The first end of the second resistor being operably connected to the cathode of the first diode and the parallel combination operably connected between the second end of the second resistor and the first end of the first capacitor.

Further scope of applicability of the present invention will become apparent from the following detailed description, claims, and drawings. However, it should be understood that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention will become more fully understood from the detailed description given here below, the appended claims, and the accompanying drawings in which:

DETAILED DESCRIPTION OF THE PREFERRED EMBODIMENT

An ionization measuring circuit detects an ionization current in a combustion chamber of an internal combustion engine by applying a bias voltage across a spark plug gap. The present invention provides a regulated power supply that applies a bias voltage across the plug electrodes by harvesting the excess ignition coil leakage and magnetizing energy immediately following turn off of the ignition coil Insulated Gate Bipolar-Junction Transistor (IGBT). The present invention uses a two-stage power supply circuit to harvest the energy.

In addition, the present invention includes a dual-rate charge pump which uses the harvested ignition coil flyback energy to provide a regulated ionization detection power supply at the first ignition event. In other words, the power supply can be ready for ionization detection within tens of microseconds after the start of ignition.

Using a two-stage, dual-rate charge pump produces an improvement in ionization system performance. For example, the ionization detection power supply fully recovers during the flyback period as a result of using a dual-rate charge pump. Since a combustion event happens right after the ignition event, engine speed or rpm is low at that time. At low engine speed, the ignition frequency is commensurately low which may cause the power supply voltage to drop significantly before the next ignition event occurs. The slow charge rate, e.g., at 20 milliseconds, may not be able to build up the ionization detection voltage fast enough to recover to a desired voltage level by the time combustion occurs. This results in poor ionization detection quality. The proposed dual-charge rate power supply of the present invention eliminates this problem by harvesting the excess ignition coil leakage and magnetizing energy immediately following the turn off of the ignition coil or power switch, normally an IGBT 22.

Figure 1:
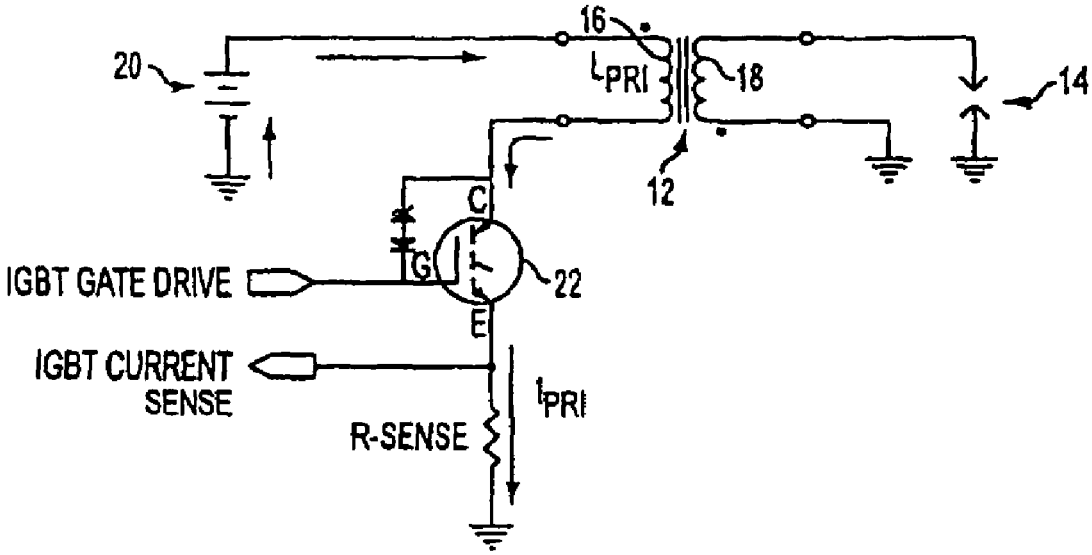
FIG. 1 is a logic block diagram of a typical ignition subsystem.

The following is a description of how a standard ignition coil charges and then releases energy. Spark ignition systems for internal combustion engines deliver sufficient energy to a spark plug 14 electrode air gap to ignite the compressed air-fuel mixture in the cylinder. To accomplish this, energy is stored in a magnetic device commonly referred to as an ignition coil 12. The stored energy is then released to the spark plug 14 air gap at the appropriate time to ignite the air-fuel mixture which is the ignition event. A schematic diagram of a typical ignition coil is shown in FIG. 1. The coil 12, which is shown as a flyback transformer, consists of primary 16 and secondary windings 18 that are magnetically coupled via a highly permeable magnetic core. The secondary winding 18 normally has many more turns than the primary winding 16, which allows the secondary voltage to fly up to very high levels during the "flyback" time.

Figure 2:
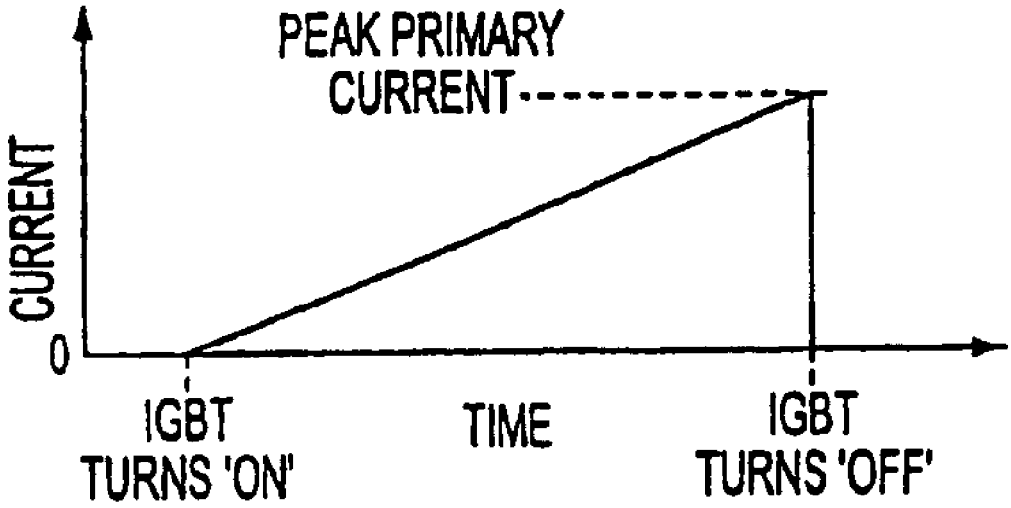
FIG. 2 is an ignition coil charging current profile.

Energy is stored in the coil by turning on the IGBT 22, and applying battery voltage across the primary winding 16 of the ignition coil 12. With a constant voltage applied to the primary inductance ($L_{pri}$), primary current ($I_{pri}$) increases linearly until primary current $I_{pri}$ reaches a predetermined level as illustrated in FIG. 2. It follows that the energy stored in the coil is a square function of the coil primary current per the following equation:

$$\text{Energy}=\tfrac{1}{2}\times L_{pri}\times(I_{pri})^2$$

Once the primary current ($I_{pri}$) has reached a predetermined peak level, the primary power switch IGBT 22 is turned off. When this occurs, the energy stored in the coil inductance ($L_{pri}$) causes the transformer primary voltage to reverse and fly up to the IGBT 22 clamp voltage, nominally 350 to 450 volts. Since the secondary winding 18 is magnetically coupled to the primary winding 16, the secondary voltage also reverses, rising to a value equal to the primary clamp voltage multiplied by the secondary to primary turns ratio, typically 20,000 to 40,000 volts. This high voltage appears across the electrodes of the spark plug 14, causing a small current to flow between the spark plug 14 electrodes through the electrode air gap. Though this current is small, the power dissipated in the air gap is significant due to the high voltage across the air gap.

The power dissipated in the electrode air gap rapidly heats the air between the electrodes causing the molecules to ionize. Once ionized, the air-fuel mixture between the electrodes conducts heavily, dumping the energy stored in the flyback transformer 12 in the spark plug 14 air gap. The sudden release of energy stored in the flyback transformer 12 ignites the air-fuel mixture in the cylinder.

Turning now to a brief description of in-cylinder ionization detection, different methods of providing a regulated power supply, and the advantages and disadvantages of each method. In-cylinder ionization detection requires a regulated power supply to establish a bias voltage across the spark plug 14 electrodes. This voltage, which is generally in the 80 to 150 volt DC range, produces an ionization current ($I_{ion}$) that is nominally limited to a few hundred micro-amps. The resulting ionization current ($I_{ion}$) is then sensed and amplified to produce a usable signal for combustion diagnostic and control purposes.

Since the magnitude of the ionization current ($I_{ion}$) is relatively small, the sensing and amplifying electronics are typically located close to the coil 12 and spark plug 14. In addition, the high voltage power supply is located very close to the ionization electronics to avoid bussing high voltages under a car hood. Therefore, means are provided to create the high voltage locally.

There are a number of different ways for providing a regulated power supply for detecting ionization current inside the cylinder. One method of creating the ionization potential is to use a DC—DC converter to create an 80 to 150 volt power supply from the available 12 Vdc at the ignition coil 12. This method, though straightforward and reliable, requires several components to implement and, therefore, may be cost and space prohibitive.

Another method for providing a regulated power supply for detecting ionization current inside the cylinder is to charge a capacitor from the collector of the primary IGBT 22 immediately following IGBT 22 turn off. A first benefit of this method is that it does not require a separate boost converter to create the ionization bias voltage. A second benefit is that the regulated power supply captures at least part of the energy stored in the transformer leakage inductance and transfers the energy to the energy storage capacitor. Normally, this energy would be dissipated on the IGBT 22 as heat, raising the operating temperature of switch IGBT 22.

Figure 3:
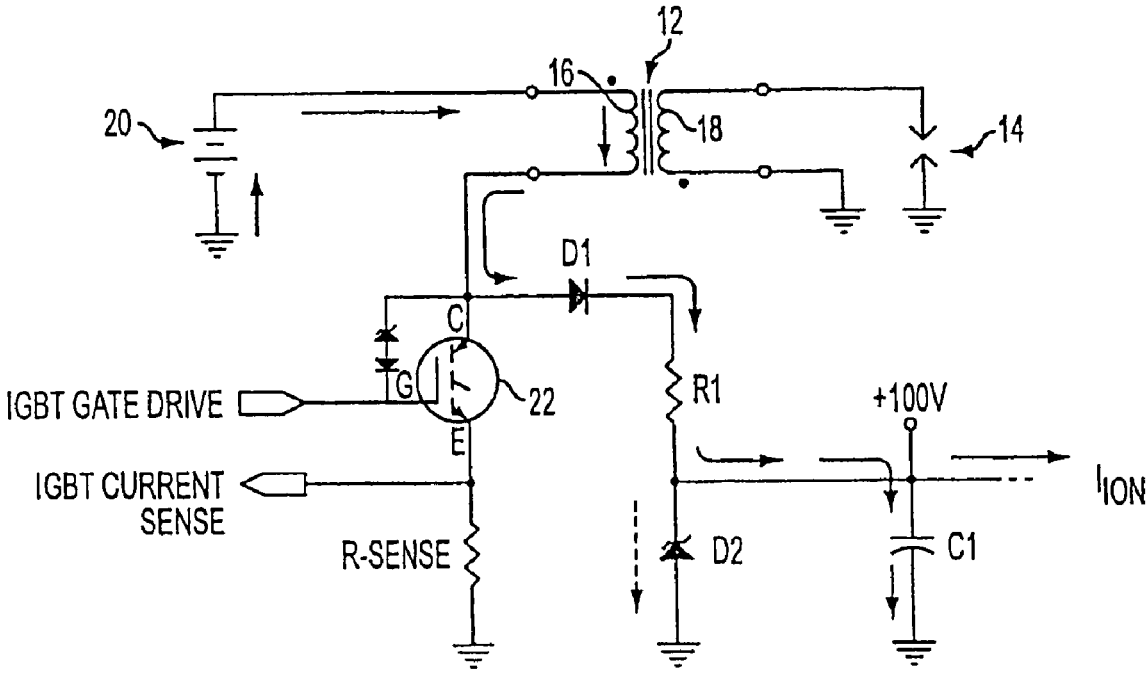
FIG. 3 is a logic block diagram of an ionization detection power supply which uses single stage flyback charging.

An embodiment of this method is shown schematically in FIG. 3. As previously described, the energy stored in the coil inductance ($L_{pri}$) causes the transformer primary voltage to reverse and fly up to the IGBT 22 clamp voltage, 350 to 450 volts, when the IGBT 22 turns off. When this occurs, diode D1 is forward biased allowing a current to flow through D1 and the current limiting resistor R1 into capacitor C1. Zener diode D2 limits the voltage on capacitor C1 to approximately 100 volts.

A first disadvantage of this method is that the energy storage capacitor C1 stores energy at a relatively low voltage, 100 volts, compared to the magnitude of the flyback voltage, approximately 400 volts. Since the energy stored in the capacitor C1 is a function of the square of the capacitor voltage, storing energy at a low voltage requires a much higher value of capacitance for a given amount of stored energy than if the capacitor was allowed to charge to a higher voltage. For example, to store 500 $\mu$-joules at 100 volts requires a 0.1 $\mu$fd capacitor. To store the same energy at 200 volts requires only a 0.025 $\mu$fd capacitor. The capacitance is reduced by a factor of four by doubling the capacitor voltage.

A second disadvantage of this method is that the **R1*C1 time constant must be short enough to allow a complete recharge of capacitor C1 in the short time between IGBT 22 turn off and spark plug firing, normally less than ten microseconds. At the same time, capacitor C1 must be large enough to supply ionization current ($I_{ion}$) without a substantial drop in the voltage on capacitor C1 under worst-case conditions such as low rpm and fouled spark plug. This forces resistor R1 to be a relatively small value, tens of ohms, and results in a relatively large capacitor charging current when the IGBT 22** turns off. Under nominal operating conditions, 2000 to 3000 rpm and a clean spark plug, the discharge on capacitor C1 due to ionization is moderate resulting in excess charging current being diverted into the zener diode D2. The product of excess zener diode current and zener voltage constitutes energy wasted in the zener diode D2.

Figure 4:
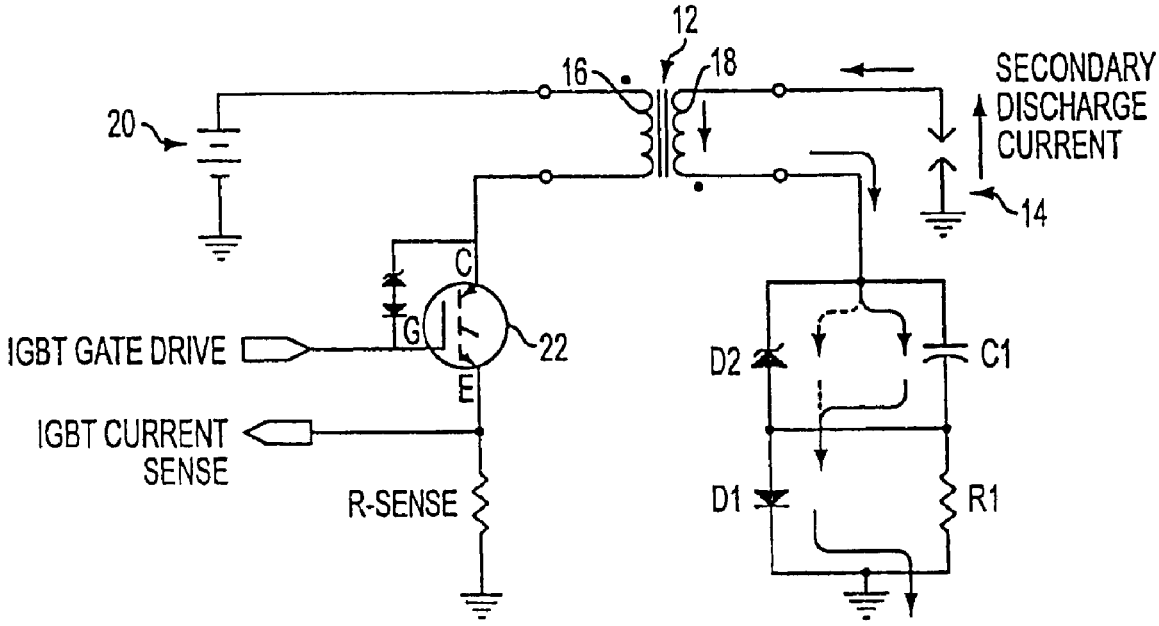
FIG. 4 is a logic block diagram of an ionization detection power supply which uses secondary current.

Another method for providing a regulated power supply for detecting ionization current inside the cylinder is to charge an energy storage capacitor with the secondary ignition current by placing the capacitor in series with the secondary winding 18 of the flyback transformer 12. An embodiment of this method is shown schematically in FIG. 4. Spark current flowing in the secondary winding 18 of the ignition coil 12 charges the energy storage capacitor C1 via diode D1. Once the voltage on capacitor C1 reaches the zener voltage, secondary current is diverted through the zener diode D1, limiting the voltage on capacitor C1 to approximately 100 volts.

Since capacitor C1 is in series with the secondary winding, it is difficult to harvest leakage energy to charge capacitor C1. A portion of the energy which would normally be delivered to the spark gap is now stored in capacitor C1. Therefore, the stored magnetizing energy in the transformer 12 is increased to compensate for this energy diversion.

Figure 5:
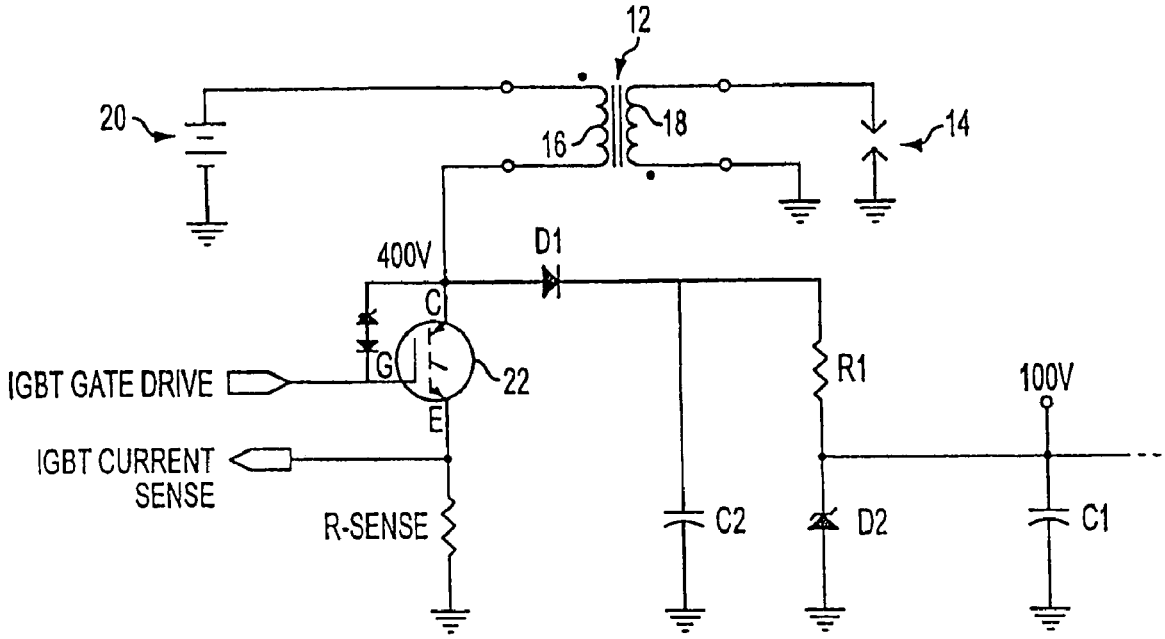
FIG. 5 is a logic block diagram of an ionization detection power supply which uses two-stage flyback charging.

Another method provides a regulated power supply for detecting ionization current inside the cylinder by harvesting the excess ignition coil leakage and magnetizing energy in a manner which is more effective than the previously described techniques. FIG. 5 is a schematic diagram of the circuit that employs this method. At first glance, the circuit appears to be similar to the second circuit disclosed in FIG. 3 described supra in which an energy storage capacitor is charged from the primary winding.

Energy storage capacitor, C2, is added and replaces capacitor C1 as the primary energy storage device. As shown in FIG. 5, one terminal of capacitor C2 is connected to the cathode of diode D1 and the other terminal of capacitor C2 is connected to ground. Energy is stored in the coil by turning on power switch IGBT 22, and applying battery voltage across the primary winding 16 of the ignition coil 12 (Step 100 in FIG. 6). When the switch IGBT 22 turns off, the energy stored in the coil leakage and magnetizing inductances causes the transformer primary voltage to reverse. The collector voltage of the IGBT 22 increases rapidly until the collector voltage exceeds the voltage on capacitor C2 by one diode drop, 0.7 volts. At this point, diode D1 forward biases, allowing a forward current to flow through diode D1 into capacitor C2. When this occurs, energy that is stored in the transformer leakage inductance is transferred to capacitor C2 instead of being dissipated on the IGBT (Step 110 in FIG. 6). Some transformer magnetizing energy may be transferred to capacitor C2 as well.

R1, which is now a much larger value, hundreds of kohms, is sized to supply enough current from the high voltage capacitor reservoir C2 to satisfy the average ionization current requirements, and to provide adequate bias current to voltage regulator diode D2. Because resistor R1 is such a large value, there is a reduced excess current flow in diode D2. This significantly reduces the energy wasted on the voltage regulator diode D2 compared to the other techniques previously described.

When the spark plug 14 fires, the secondary voltage collapses and the magnetizing energy stored in the transformer 12 is delivered to the spark gap to ignite the air-fuel mixture in the cylinder. Simultaneously, the primary voltage collapses, reverse biasing D1 and ending the charging of capacitor C2. At this time, C2 is at its maximum voltage, typically 350 to 400 volts. Capacitor C2 now acts as the primary energy reservoir to maintain the charge on capacitor C1 while supplying current to the ionization circuits and the voltage regulator diode D1 (Step 120 in FIG. 6).

Figure 6:
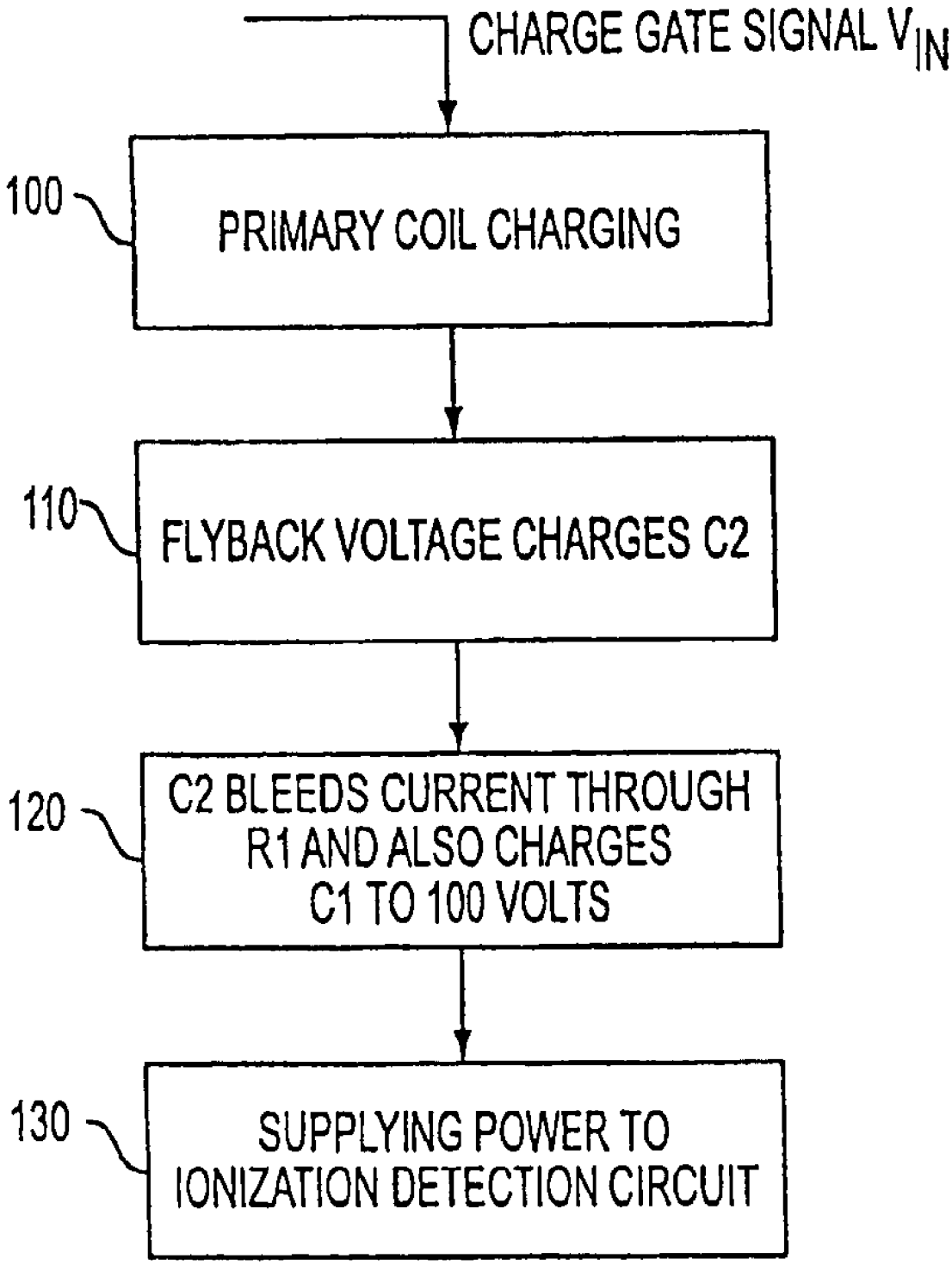
FIG. 6 is a flowchart which illustrates the steps taken by a circuit that provides a regulated power supply for in-cylinder ionization detection by harvesting excess ignition coil leakage and magnetizing energy.

Capacitor C2 is sized to supply average ionization current under worst case conditions, e.g., 600 rpm and fouled spark plug, while maintaining a sufficiently high voltage to regulate the ionization supply bus voltage at 100 volts (Step 130) to lower voltage capacitor C1. Since capacitor C1 is no longer the primary energy storage element, capacitor C1 need only be large enough to limit the voltage drop on the ionization bus to acceptable levels while supplying transient ionization currents. Steady state currents are supplied by capacitor C2. FIG. 6 illustrates the steps by which the circuit provides a regulated power supply for in-cylinder ionization detection by harvesting excess ignition coil leakage and magnetizing energy One of the disadvantages of using a two-stage charging approach is that the ionization detection power supply will not be available after the first ignition event due to the long settling time. The main reason is that the time constant due to resistor R1 and C1 is relatively large, leading to a long time period before the capacitor voltage settles. For example, assuming resistor R1 is 1.8 Megaohms and capacitor C1 is 0.1 microfarad, the RC time constant, R1*C1, is equal to 180 milliseconds. If it is assumed that the capacitor voltage settles to an acceptable voltage level within 4 time constants, then the total time before the capacitor C1 will be able to supply power to the ionization circuit will be approximately 720 milliseconds. If the engine is running at 300 RPM, 720 milliseconds is equivalent to almost 650 crank degrees. This indicates that the ionization detection power supply will not be available until 650 crank degrees after the first ignition event. Furthermore, using multiple spark events will not reduce the settling time since the same time constant applies.

Figure 7:
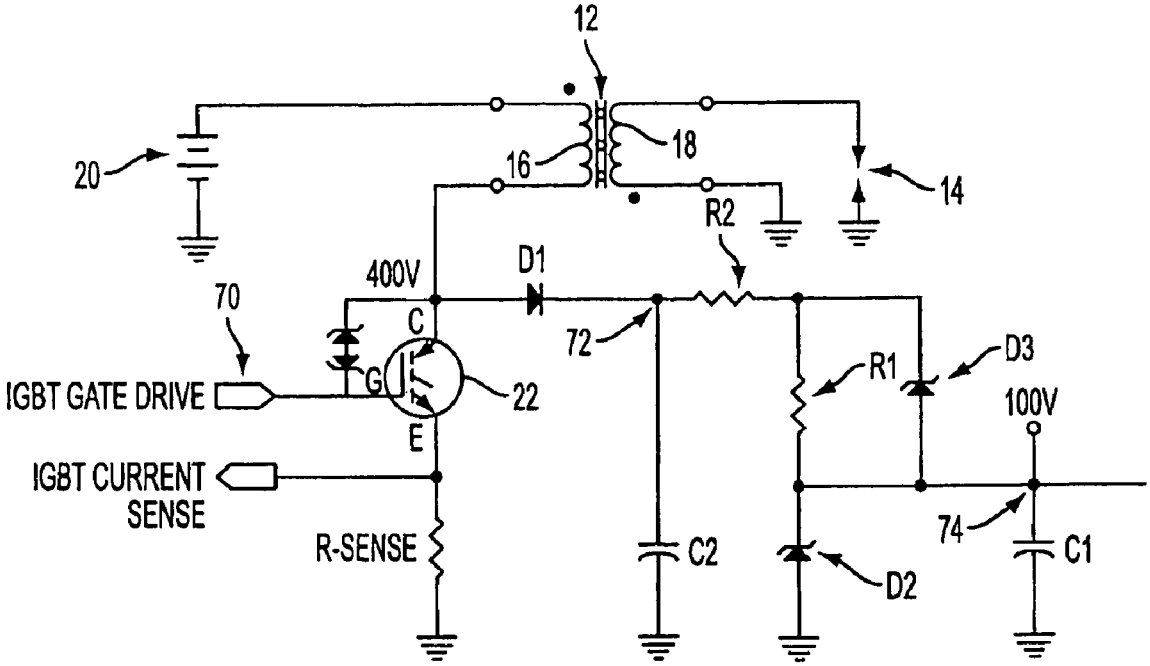
FIG. 7 is a logic block diagram of an ionization detection power supply which uses dual-charge charging.

The present invention combines the signal-stage power supply circuit shown in FIG. 3 and the two-stage power supply circuit shown in FIG. 5 into a two-stage power supply circuit for ionization detection with dual charge rates. This two-stage, dual rate power supply circuit is shown in FIG. 7. Use of another resistor R2 and another zener diode D3 make a dual charge rate possible. The circuit disclosed in FIG. 7 has two charge time constants (R1+R2)*C1 and R2*C1.

The following is a description of the operation of the circuit disclosed in FIG. 7. After dwell control signal 70 goes from logic "high" to logic "low", switch IGBT 22 is turned off. The dwell control voltage 70 controls the amount of time that the supply voltage is applied to the primary coil. This is known as the dwell time. As a result of IGBT 22 being switched on and off, the energy stored in the coil leakage and the magnetizing inductances causes the transformer primary voltage to reverse and produce a flyback voltage. The collector voltage of the IGBT 22 increases rapidly until the collector voltage exceeds the voltage 72 on capacitor C2 by one diode drop, 0.7 volts. At this point, diode D1 forward biases, allowing a forward current to flow through diode D1 into capacitor C2. When this occurs, part of the energy that is stored in the transformer leakage inductance is transferred to capacitor C2 instead of being dissipated in the IGBT 22.

Figure 8:
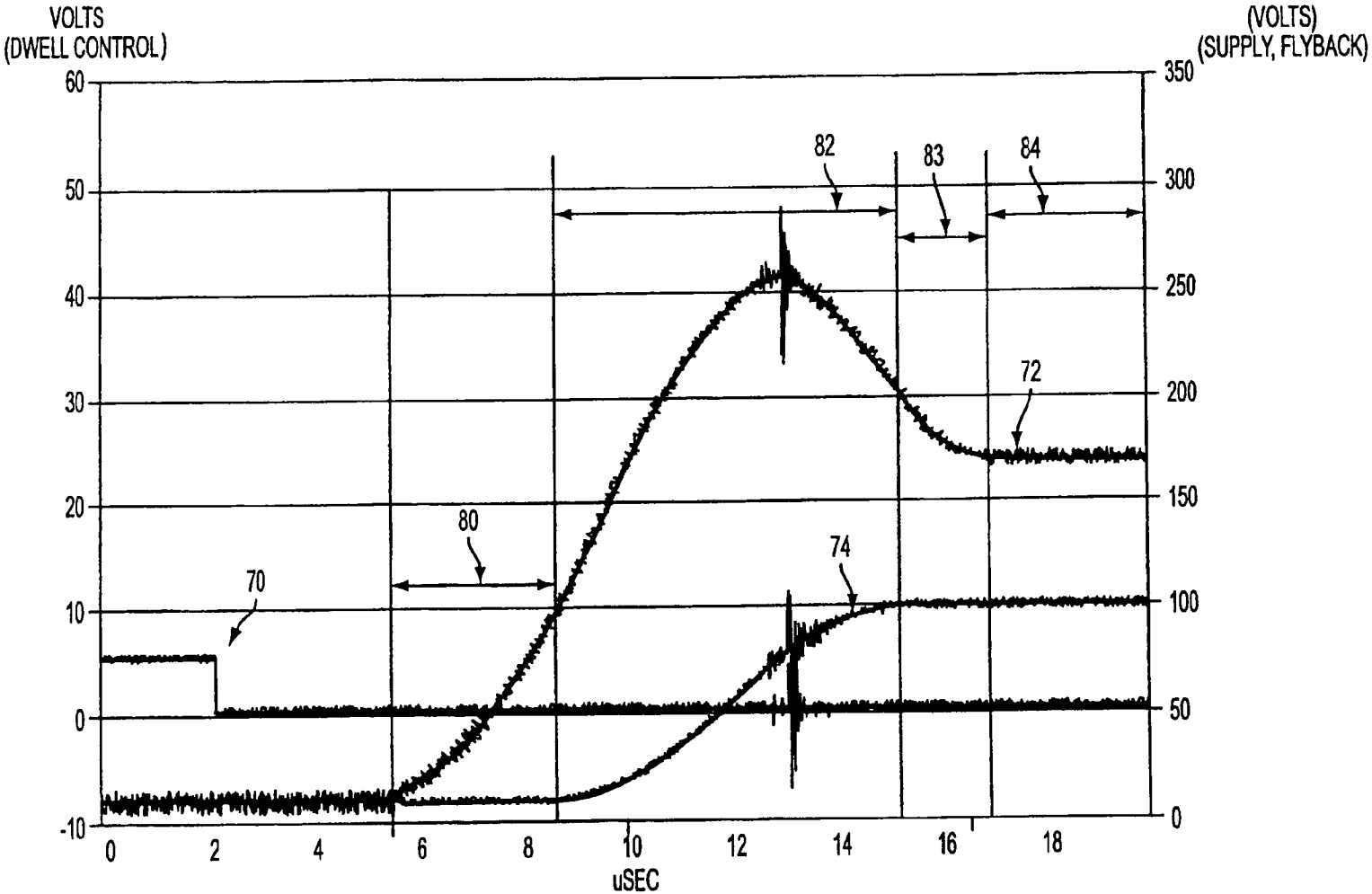
FIG. 8 is a plot of the dwell control voltage, the flyback voltage, the first stage supply voltage and the supply output voltage of the ionization detection power supply of the present invention.

Capacitors C1 and C2 are charged and discharged over four time periods as illustrated in FIG. 8. During the first time period 80, the flyback voltage exceeds the voltage 72 of capacitor C2 by a diode drop, 0.7 volts. As a result, the flyback voltage supplies energy to capacitor C2 to charge the first-stage power supply capacitor C2. When the voltage 72 of capacitor C2 exceeds the sum of voltage 74 of capacitor C1 and the breakdown voltage of diode D3, the first period 80 ends and the second period 82 begins. During this second time period 82, the flyback voltage supplies energy to the first-stage power supply capacitor C2 directly and to the second-stage power supply capacitor C1 through resistor R2. After the flyback voltage drops below the sum of voltage 74 of capacitor C1 and the breakdown voltage of zener diode D3, the second time period 82 ends and the third time period 83 begins. During this third time period 83, the flyback voltage only charges capacitor C1. After the third period 83, the flyback voltage further depletes below the voltage 72 of capacitor C2. In this fourth time period 84, current no longer flows through diode D1. In addition, the output stage, or second-stage, voltage 74 of the power supply is charged only by the first-stage voltage 72 of capacitor C2 through resistors R1 and R2.

As stated earlier, two time constants are used to charge capacitor C1, R2*C1 and (R1+R2)*C1. After the voltage 72 on capacitor C2 of the first stage power supply exceeds the sum of the breakdown voltage of zener diode D3 and the voltage 74 across capacitor C1 of the second stage power supply, the first time period 80 ends and the second time period 82 begins. During the second time period 82, the flyback voltage supplies energy to capacitor C1 through resistor R2. The time constant for charging capacitor C1 is R2*C1. This time constant is valid until the voltage across C1 reaches the breakdown voltage of zener diode D2, where zener diode D2 starts to conduct and limits the voltage across capacitor C1. In addition, some transformer magnetizing energy is transferred to capacitor C1 through resistor R1 as well.

During the second charge period 82, the voltage 74 settling time of capacitor C1 is primarily dependent on the time constant R2*C1. By selecting a relatively small time constant, capacitor C1 can be fully charged during the second charge period 82. FIG. 8 shows that after turn-off of the dwell control signal 70 the voltage 74 of the second-stage power supply capacitor C1 can be charged from 0 to 100 volts in approximately 13 microseconds. Therefore, the ionization detection power supply can be ready to supply power for ion detection right after the start of the ignition event.

After the first-stage power supply voltage 72 across capacitor C2 falls below the sum of the breakdown voltage of zener diode D3 and voltage 74 of capacitor C1, the second charge period 82 is complete and the third charge period 83 begins. During the third 83 and fourth charge periods 84, capacitor C2 continues to provide the energy to maintain the second-stage power supply voltage 74 across capacitor C1 at the desired voltage level which is around 100 volts in the illustrated implementation. During the third charge period 83, the voltage across zener diode D3 is below the breakdown voltage of zener diode D3 so the current path to capacitor C1 changes. Current now flows from the first-stage power supply capacitor C2 through resistors R2 and R1 into the second-stage power supply capacitor C1. Thus, the charge time constant of the circuit then becomes (R1+R2)*C1 when the voltage of C1 is below the breakdown voltage of zener diode D2. The time constant changed because the current path to capacitor C1 changed.

In summary, the first current path comprises a first resistive value R2, but does not include the second resistive value R1 because the current path through resistor R1 is effectively shorted by the low impedance path provided by zener diode D3. The second current path comprises both first resistive value R2 and second resistive value R1. In the dual-stage, dual charge rate power supply circuit, the value of resistor R1 is much greater than the value of resistor R2. As a result, during the flyback period capacitor C1 can be charged very quickly by a larger current with very small time constant. However, between ignition events a much smaller current flows to maintain the charge of capacitor C1 due to the addition of a second resistive value R1. If the value of resistor R2 is too large, capacitor C1 will not charge quickly enough on the first ignition event. On the other hand, if the value of resistor R1 is too small, excessive current will flow through zener diode D2 and the charge on capacitor C2 will deplete prematurely.

The following are some of the advantages provided by the dual-stage, dual charge rate power supply circuit for ionization detection.

First, the dual-stage, dual charge rate power supply circuit for ionization detection uses the energy stored in the transformer leakage inductance for two purposes. First, to capture part of the transformer leakage inductance energy as a supplemental energy source for the ionization electronic circuit after capacitor C1 is charged. Secondly, to charge capacitor C1 with a fast charge rate, i.e., with a short settling time. This allows for a minimal recovery time of the ionization detection power supply.

Second, the dual-stage, dual charge rate power supply circuit for ionization detection reduces the dissipation and resulting heating of the primary IGBT 22 by diverting the leakage energy into both capacitors C1 and C2 instead of allowing the leakage energy to be dissipated in the IGBT.

Third, the fast charge rate during the second charge period 82 allows the ionization detection power supply to recover fully during the flyback period. In the example circuit used to generate FIG. 8, the output supply voltage 74 of capacitor C1 was charged from 0 to 100 volts in approximately 6 microseconds or 0.0216 crank degrees at 600 RPM. This ensures that the high quality power is made available immediately after the ignition event. In addition, the fast charge rate provides an advantage particularly when the engine is operated at a low speed because the amount of delay caused by the settling time of the ionization power supply when measured in crank angles is greater at lower speeds.

Fourth, storing part of the flyback energy at a high voltage in capacitor C2 allows a smaller capacitor C1 to be used. In the circuit used to generate the waveforms in FIG. 8, the value of capacitor C2 was 100 nF. Since energy stored in a capacitor increases as the square of the capacitor voltage, a higher capacitor voltage allows use of a smaller capacitor in the ionization detection circuit of the present invention than has been previously disclosed in the prior art.

Fifth, the dual-stage, dual charge rate power supply circuit for ionization detection reduces the energy wasted on the voltage regulator diode D2 by increasing the value of the current limiting resistor R1 such that the voltage regulator diode D2 does not see large reverse currents.

Sixth, the fast charge rate during the second charge period 82 also allows the ionization detection power supply to be ready when an ignition event occurs which allows cylinder identification using the ionization current signal during the ignition event.

The following table provides the typical values and ratings for components and time constants of the demonstrating circuit shown in FIG. 7.

| Components and Time Constants | Ratings | Nom. Value | Units |
|---|---|---|---|
| R1 | Resistor (100 mW) | 1.8 | MegaOhms |
| R2 | Resistor (100 mW) | 33 | Ohms |
| C1 | Capacitor (200 V) | 100 | nanoFarads |
| C2 | Capacitor (630 V) | 100 | nanoFarads |
| D1 | Diode (600 V, 1 A) | N/A | N/A |
| D2 | Zener Diode (1.5 W) | 100 | Volts |
| D3 | Zener Diode (1.5 W) | 100 | Volts |
| 2*II*(R1 + R2)*C1 | Time Constant | 1.13 | Seconds |
| 2*II*R2*C1 | Time Constant | 20.7 | microSeconds |

While the invention has been disclosed in this patent application by reference to the details of preferred embodiments of the invention, it is to be understood that the disclosure is intended in an illustrative rather than in a limiting sense, as it is contemplated that modification will readily occur to those skilled in the art, within the spirit of the invention and the scope of the appended claims and their equivalents.

What is claimed is:

1. A method of providing a regulated power supply for in-cylinder ionization detection, comprising the step of charging an ionization detection circuit using a plurality of charge rates, wherein said step of charging an ionization detection circuit using a plurality of charge rates comprises:

charging a capacitor with at least two charge rates, charging said capacitor using a first time constant during a time period, and charging said capacitor using a second time constant after said time period has elapsed.

2. The method according to claim 1 wherein said plurality of charge rates includes at least one charge rate wherein an ionization detector supplies power when an ignition event occurs.

3. The method according to claim 1 wherein said at least two charge rates includes at least one charge rate wherein an ionization detection supply voltage supplies power when an ignition event occurs.

4. The method according to claim 1 wherein said step of charging a second capacitor using at least two charge rates includes:

charging said capacitor through a first current path during a time period; and charging said capacitor through a second current path after said time period has elapsed.

5. The method according to claim 4 wherein said first current path includes a first resistive value and said second current path includes a second resistive value.

6. The method according to claim 5 further including the step of capturing energy stored in a transformer leakage inductance and using said captured energy as an energy source for an ionization electronics circuit.

7. The method according to claim 1 wherein said capacitor is fully charged during said time period.

8. A method of providing a regulated power supply for in cylinder ionization detection, comprising the steps of:

turning a switch off;

reversing a transformer primary voltage; and charging an ionization detection circuit using a plurality of charge rates, wherein said step of charging an ionization detection circuit with a plurality of charge rates includes:

charging an energy storage device with a fiat time constant during, a second time period; and charging said energy storage device with a second time constant after said second time period has elapsed.

9. The method according to claim 8 wherein said step of charging an ionization detection circuit using a plurality of charge rates includes:

charging an energy storage device with a first time constant after a first stage power supply voltage exceeds a sum of a breakdown voltage and a second stage power supply voltage; and charging said energy storage device with a second time constant after a first stage power supply voltage falls below a sum of a breakdown voltage and a second stage power supply voltage.

10. The method according to claim 8 wherein said energy storage device is fully charged during a second time period.

11. The method according to claim 10 wherein said energy storage device settles within six microseconds.

12. A dual stage ionization detection circuit, comprising:

a first diode having an anode and a cathode, wherein said anode is operably connected to a first end of a primary winding;

a first capacitor having a first end and second end, whereby said second end is operably connected to ground;

a second capacitor having a first end and a second end, whereby said first end is operably connected to said cathode of said first diode and said second end is operably connected to ground;

a first current path operably connected between said first and said second capacitor; and a second current path operably connected between said first and said second capacitor.

13. The dual stage ionization detection circuit according to claim 12 wherein said first current path and said second current path include:

a second diode having an anode and a cathode operably connected in parallel with said first capacitor;

a parallel combination of a first resistor having a first and a second end and a third diode having an anode and a cathode; and a second resistor having a first and a second end, wherein said first end is operably connected to said cathode of said first diode and said parallel combination is operably connected between said second end of said second resistor and said first end of said first capacitor.

14. The dual stage ionization detection circuit according to claim 12 wherein said first current path includes:

a resistor having a first and second end, wherein said first end is operably connected to said cathode of said first diode; and another diode having an anode and a cathode, wherein said another diode is operably connected between said second end of said resister and said first end of said first capacitor.

15. The dual stage ionization detection circuit according to claim 12 wherein said second current path includes:

a first resistor having a first and a second end, and a second resistor having a first and a second end, wherein said first end is operably connected to said cathode of said first diode and said first resistor is operably connected between said second end of said second resistor and said first end of said first capacitor.

16. The dual stage ionization detection circuit according to claim 12 wherein said first current path includes a first resistive value and said second current path comprises a second resistive value.

17. The dual stage ionization detection circuit according to claim 12 said second diode and said third diode are zener diodes.

* * * * *

UNITED STATES PATENT AND TRADEMARK OFFICE

CERTIFICATE OF CORRECTION

PATENT NO. : 7,005,855 B2
DATED : February 28, 2006
INVENTOR(S) : Guoming G. Zhu et al.

It is certified that error appears in the above-identified patent and that said Letters Patent is hereby corrected as shown below:

Column 9,
Lines 57-58, “in cylinder” should be -- in-cylinder --.
Line 65, “fiat” should be -- first --.
Line 66, after “during” delete “,”.

Column 10,
Line 49, “resister” should be -- resistor --.
Line 55, “end” should be -- end; --.
Line 66, after “12” insert -- wherein --.

Signed and Sealed this

Sixth Day of June, 2006

JON W. DUDAS
*Director of the United States Patent and Trademark Office*

UNITED STATES PATENT AND TRADEMARK OFFICE

CERTIFICATE OF CORRECTION

PATENT NO. : 7,005,855 B2
APPLICATION NO. : 10/738550
DATED : February 28, 2006
INVENTOR(S) : Guoming G. Zhu et al.

It is certified that error appears in the above-identified patent and that said Letters Patent is hereby corrected as shown below:

Column 9,
Lines 57-58, "in cylinder" should be -- in-cylinder --.
Line 65, "fiat" should be -- first --.
Line 66, after "during" delete ",".

Column 10,
Line 51, "resister" should be -- resistor --.
Line 55, "end," should be -- end; --.
Line 66, after "12" insert -- wherein --.

This certificate supersedes Certificate of Correction issued June 6, 2006.

Signed and Sealed this

Twenty-first Day of November, 2006

JON W. DUDAS
*Director of the United States Patent and Trademark Office*